US007022059B2

(12) United States Patent
Kitai et al.

(10) Patent No.: US 7,022,059 B2
(45) Date of Patent: Apr. 4, 2006

(54) CHOPPER FOLDER FOR ROTARY PRESS

(75) Inventors: Mitsuo Kitai, Yokohama (JP); Yuuji Iiizumi, Kawasaki (JP); Takeo Nanba, Yokohama (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 156 days.

(21) Appl. No.: 09/897,114

(22) Filed: Jul. 3, 2001

(65) Prior Publication Data

US 2002/0039956 A1 Apr. 4, 2002

(30) Foreign Application Priority Data

Oct. 4, 2000 (JP) ..... P. 2000-304449

(51) Int. Cl.
*B31F 1/10* (2006.01)

(52) U.S. Cl. ..... 493/444; 493/434; 493/442

(58) Field of Classification Search ..... 493/442, 493/444, 434, 435, 427; 74/49, 55; 73/7; 83/617

See application file for complete search history.

(56) References Cited

U.S. PATENT DOCUMENTS 3,632,104 A * 1/1972 Dugour ..... 493/444
3,817,139 A * 6/1974 Desai et al. ..... 83/617
5,085,625 A * 2/1992 Kojima ..... 493/444
5,222,934 A * 6/1993 Ochsner ..... 493/444
6,457,345 B1 * 10/2002 Gebert et al. ..... 73/7

FOREIGN PATENT DOCUMENTS

| | | |
|---|---|---|
| JP | 62-74650 | 5/1987 |
| JP | 5-24738 | 2/1993 |
| JP | 5-22446 | 3/1993 |
| JP | 6-199471 | 7/1994 |
| JP | 2983247 | 9/1999 |

* cited by examiner

*Primary Examiner*—Louis Huynh
(74) *Attorney, Agent, or Firm*—Westerman, Hattori, Daniels & Adrian, LLP

(57) ABSTRACT

A chopper folder for a rotary press folds signatures which are periodically conveyed, one signature at a time, from a folding machine. The chopper folder includes a pair of folding rollers for folding a signature parallel to the conveyance direction, a prime mover, a crank arm fixed to an output shaft of the prime mover to be rotated together with the output shaft, a blade holder connected to the crank arm via a link, a chopper blade held in the blade holder and adapted to push the signature from an upper surface thereof in order to insert the signature into a space between the pair of folding rollers, and guide units for restricting motion of the blade holder such that the blade holder reciprocates only in a direction perpendicular to a conveyance plane along which the signature is conveyed.

2 Claims, 5 Drawing Sheets

CHOPPER FOLDER FOR ROTARY PRESS

BACKGROUND OF THE INVENTION

1. Field of the Invention

The present invention relates to a chopper folder for a rotary press for folding signatures periodically conveyed from a folding machine of a rotary press, and more specifically to a chopper folder equipped with a blade for pushing a signature into a space between a pair of folding rollers in order to fold the signature parallel to the conveyance direction.

2. Description of the Related Art

Conventional chopper folders have employed various schemes in order to move a chopper blade; e.g., a scheme in which a chopper blade is moved along an arcuate path and a scheme in which a chopper blade is moved along a linear path. In recent years, in order to cope with increased operation speed of rotary presses, the linear motion scheme—which can reduce the inertia of a movable portion—has been employed in many cases. Techniques in relation to such a linear motion scheme are disclosed in, for example, Japanese Patent Application Laid-Open (kokai) No. 6-199471, Japanese Patent No. 2983247, and Japanese Utility Model Application Laid-Open (kokai) No. 5-22446.

In the apparatus (Conventional Apparatus 1) disclosed in Japanese Patent Application Laid-Open No. 6-199471, two planetary gear mechanisms are disposed adjacent to each other. One of the planetary gear mechanisms has a first rotary shaft which rotates about its own axis, while revolving about a first center line. The base end of a first arm is fixedly connected to the first rotary shaft; and the distal end of the first arm is rotatably coupled to one end portion of a chopper blade. The other planetary gear mechanism has a second rotary shaft which rotates about its own axis, while revolving, in the direction opposite the above revolving direction, about a second center line parallel to the first center line. The base end of a second arm is fixedly connected to the second rotary shaft, and the distal end of the second arm is rotatably coupled to the other end portion of the chopper blade. Gears formed on the respective outer circumferential portions of respective disks of the two planetary gear mechanisms are meshing-engaged in order to form a paired mechanism.

Opposite longitudinal ends of an upper edge of the chopper blade, which is a far-side edge with respect to a conveyance plane along which signatures are conveyed, are supported via bearings by means of shafts provided at the respective distal ends of the first and second arms.

Each of the planetary gear mechanisms has the following configuration. A cylindrical main gear having gear teeth on its outer circumferential portion is fixed to a frame to be aligned with the corresponding center axis. A rotary center shaft is passed through a hollow of the cylindrical main gear. An intermediate gear in meshing engagement with the main gear and a small gear in meshing engagement with the intermediate gear are rotatably attached to the corresponding disk. The small gear is fixed to the corresponding rotary shaft to be integral with the corresponding arm.

When the first and second rotary shafts are simultaneously revolved in opposite directions about the first and second center axes, respectively, the chopper blade is moved upward and downward by the first and second arms. In order to cancel out dynamic imbalance forces generated in the vertically moving chopper blade to thereby create a balanced state, a counterweight is attached to each rotary shaft on the opposite side of the corresponding arm. One of the rotary center shafts rotatable about the respective center lines is rotated by means of drive torque transmitted from the folding machine via a belt. The disks are integrally fixed to the end portions of the rotary center shafts to be integral therewith. The disks rotate while maintaining engagement between gears provided on the outer circumferential portions of the disks.

Each of the planetary gear mechanisms operates as follows. When the rotary center shaft is rotated, the disk is rotated, so that the intermediate gear supported by the disk and being in meshing engagement with the main gear is rotated, and the small gear supported by the disk and being in meshing engagement with the intermediate gear is rotated. As a result, the intermediate gear and the small gear revolve about the center line, so that the arm fixedly connected to the small gear rotates about the rotary shaft, together with the counterweight. Thus, the chopper blade is moved upward and downward by the arm.

In the apparatus (Conventional Apparatus 2) disclosed in Japanese Patent No. 2983247, two linear-feed crank mechanisms are connected to opposite longitudinal ends of a chopper blade. Each linear-feed crank mechanism includes two crank members having the same arm length and two links having the same length. The crank members are arranged in the longitudinal direction of the chopper blade and are rotated in opposite directions. The upper ends of the links are coupled to the respective crank members via pins. The lower ends of the links are coaxially coupled to the upper end of the corresponding longitudinal end of the chopper blade via a pin. Rotary shafts of all the crank members of the two linear-feed crank mechanisms are supported by the gear box.

One of the rotary shafts of the two linear-feed crank mechanisms is rotated by a motor connected directly to the rotary shaft or a drive unit of the folding machine. As a result, gears which are provided on the rotary shafts of the two linear-feed crank mechanisms and which are in direct meshing engagement with one another rotate, so that the linear-feed crank mechanisms operate in order to move the chopper blade upward and downward.

The apparatus (Conventional Apparatus 3) disclosed in Japanese Utility Model Application Laid-Open No. 5-22446 includes a reciprocal linear motion unit which is connected to the widthwise center of a chopper blade with respect to the conveyance direction of signatures and reciprocates the chopper blade linearly; and a guide portion for guiding the chopper blade along the direction of reciprocal linear motion. Specifically, a crank pin of a planetary gear box serving as a reciprocal linear motion unit is rotatably connected to the widthwise center of the chopper blade. Further, guide bars are fixed attached to the opposite widthwise end portions of the planetary gear box; and bearings fixed to the opposite widthwise ends of the chopper blade are supported by the guide bars such that the chopper blade is movable in the vertical direction.

The pitch circle diameter of a small gear provided in the planetary gear box is half the pitch circle diameter of an internal gear fixed to the planetary gear box. Further, the crank radius of a crank fixed to the shaft of the small gear is half the pitch circle diameter of the small gear.

Therefore, when the small gear in meshing engagement with the internal gear moves, theoretically, the crank pin moves linearly. However, in actuality, the crank pin reciprocates vertically, while swinging horizontally, along a lip-shaped arcuate path. Therefore, a hole which is formed in the chopper blade in order to receive the crank pin is elongated in the direction perpendicular to the direction of movement of the crank pin, to thereby prevent excessive force from acting on the chopper plate in the longitudinal direction as a result of swing motion of the crank pin.

The above-described Conventional Apparatus 1 has the following drawbacks.

(1) Due to employment of two planetary gear mechanisms, the structure becomes complex, and a large number of gears, which require some backlash, must be used as structural components. Therefore, highly precise machining and assembly are required. In addition, the overall size of the apparatus becomes large as a result of the large stroke of the chopper blade, and manufacturing cost is high.

(2) Imbalance force which is generated in the chopper plate moved vertically by the arms united with the small gears is canceled out by use of counterweights. However, the masses of the intermediate gears and the small gears revolving about the respective center lines break the dynamically balanced state of the rotary motion system, so that vibration, resonation, and noise are generated as a result of play such as backlash of gears, and the durability of the apparatus is impaired.

(3) The above-described vibration propagates to the chopper blade via the arms, so that the chopper blade vibrates, resulting in breakage of signatures and decreased folding accuracy. Further, resonation, etc., caused by the vibration makes coping with increased operation speed of rotary presses difficult.

The above-described Conventional Apparatus 2 has the following drawbacks.

(1) Each of the two linear-feed crank mechanisms is designed such that two crank members are rotated in opposite directions through meshing engagement of two gears connected to the crank members. Further, the inner-side gears of the two linear-feed crank mechanisms located adjacent to each other are engaged, so that four gears are disposed along a horizontal line. Therefore, the apparatus is of relatively large side. In addition, as a result of backlash of gears and variation in load acting on the crank pin portions, vibration and noise are generated, so that the chopper blade vibrates and/or resonates.

(2) The chopper blade is supported by two pairs of links such that the distal ends of each pair of links are coaxially pin-connected to the corresponding end of the chopper blade. Therefore, the rigidity of the chopping blade is difficult to maintain, and therefore, the chopping blade vibrates easily. Therefore, the chopper blade moves upward and downward, while vibrating horizontally in the longitudinal direction of the chopper blade and in the direction perpendicular thereto, so that the accuracy in folding signatures is impaired, and the apparatus cannot cope with increased operation speed of rotary presses.

(3) The linear-feed crank mechanism is mainly formed of a considerably expensive gear box which includes a large number of components. In addition, since the crank members are rotated through mutual, direct engagement between gears provided on the rotary shafts of the crank members, backlashes of the gears are accumulated, resulting in generation of large play.

(4) High machining accuracy is required to obtain an accurate distance between the center of the rotary shaft of each crank member to the center of the corresponding crank pin and an accurate distance between the centers of pin connections at opposite ends of each link. Therefore, manufacturing cost is high, and theoretical or ideal dimensions cannot be obtained, so that the apparatus causes complicated motion with vibration. Further, excessive force is easily generated, because of dimensional errors of the respective members. When the clearance between movable members is increased so as to dissipate such excessive force, durability is impaired.

The above-described Conventional Apparatus 3 has the following drawbacks.

(1) Since the reciprocal linear-motion unit for moving the chopper blade upward and downward is realized by a planetary gear box including an internal gear and a small gear, the apparatus has a complex structure and is formed of considerably expensive components. Therefore, manufacturing cost is high.

(2) In order to move the chopper blade linearly, the pitch circle diameter of the small gear is set to be half the pitch circle diameter of the internal gear, and the crank radius is set to be half the pitch circle diameter of the small gear. As a consequence of these dimensional relationships, the chopper blade moves within a large stroke corresponding to the pitch circle diameter of the internal gear, resulting in an increase in the size of the apparatus.

(3) Moreover, as a consequence of the large stroke of the chopper blade, the speed of reciprocal motion of the guide portion for guiding the motion of the chopper blade along the direction of reciprocal linear motion increases, so that the bearings wear quickly, and excessive force acts on the crank pin engaged with the chopper blade, resulting in impaired durability.

(4) Further, as described above, difficulty is encountered in obtaining the theoretical or ideal dimensional relationship in relation to the gears and the crank radius through precise matching and assembly, as well as in operating and maintaining the apparatus to move the chopper blade precisely linearly. In actuality, the locus of motion of the crank pin deviates from a straight line. Therefore, the crank pin is engaged with an elongated hole formed in the chopper blade. However, since the crank pin and the elongated hole wear, durability is low. Further, vibration and resultant resonation lower folding accuracy and make coping with high speed operation difficult.

The above-described conventional apparatuses share the following common problems.

Notably, the numbers appearing in parentheses following each common problem below correspond to the numbered drawbacks listed above for the corresponding conventional apparatuses.

1. Generation of vibration and noise (Conventional Apparatus 1-(2); Conventional Apparatus 2-(1), (3), (4); Conventional Apparatus 3-(4)).

2. Low folding accuracy (Conventional Apparatus 1-(3); Conventional Apparatus 2-(2); Conventional Apparatus 3-(4)).

3. Impossibility of coping with high-speed operation (Conventional Apparatus 1-(4); Conventional Apparatus 2-(2); Conventional Apparatus 3-(4)).

4. Large apparatus size (Conventional Apparatus 1-(1); Conventional Apparatus 2-(1); Conventional Apparatus 3-(2)).

5. Low durability (Conventional Apparatus 1-(2); Conventional Apparatus 2-(4); Conventional Apparatus 3-(3), (4)).

6. High manufacturing cost (Conventional Apparatus 1-(1); Conventional Apparatus 2-(4); Conventional Apparatus 3-(1) .

SUMMARY OF THE INVENTION

An object of the present invention is to solve the above-described problems involved in conventional apparatuses.

Another object of the present invention is to provide a compact, durable, inexpensive chopper folder which employs a considerably simple, maintenance-free structure that does not include components, such as gears, requiring precise machining and assembly and that has good dynamic balance to thereby eliminate vibration and noise, and which thereby achieves improved accuracy in folding signatures and enables coping with high-speed operation.

The present invention provides a chopper folder for a rotary press for folding signatures which are periodically conveyed, one signature at a time, from a folding machine, comprising a pair of folding rollers for folding a signature parallel to the conveyance direction; a prime mover; a crank arm fixed to an output shaft of the prime mover to be rotated together with the output shaft; a blade holder connected to the crank arm via a link; a chopper blade held in the blade holder and adapted to push the signature from an upper surface thereof in order to insert the signature into a space between the pair of folding rollers; and at least one guide unit for restricting motion of the blade holder such that the blade holder reciprocates only in a direction perpendicular to a conveyance plane along which the signature is conveyed.

The chopper folder according to the present invention achieves the following advantageous effects.

(1) The blade holder—which is connected via the link to the crank arm fixed to the output shaft of the prime mover—is supported by the guide units in order to reciprocate the chopper blade in the direction perpendicular to the conveyance plane of the signature. This configuration enables realization of a simple and compact drive transmission system which consists of a considerably small number of components, eliminates the necessity of gears, and has a very short transmission path. In addition, since vibration, resonation, and noise are hardly generated due to reciprocation of the chopper blade, silent, high-speed operation is enabled, and durability and productivity are improved.

(2) The simple and compact drive transmission system is constructed by use of members of simple shape, without use of expensive members such as gear units. Therefore, the number of components can be reduced in order to reduce manufacturing cost.

Preferably, the guide unit comprises sliders provided at opposite ends of the blade holder; and two guide rails arranged along the conveyance direction and adapted to guide the sliders. The guide rails are supported such that a clearance greater than the thickness of the signature is provided between the guide rails and the conveyance plane and each guide rail has a guide surface perpendicular to the conveyance plane. Guided portions of the sliders are movable, while maintaining close contact with the guide surfaces of the guide rails at all times.

In this case, the following additional effect is achieved.

(3) Since the guided portions of the sliders provided at the opposite ends of the blade holder always maintain close contact with the guide surfaces of the guide rails, the chopper blade is reciprocated, while its motion along a plane perpendicular to the reciprocating motion is restricted. Therefore, vibration, etc. are not generated at the drive transmission system or the chopper blade, so that the signature can be smoothly pushed into the space between the folding rollers. Accordingly, folding accuracy is improved, and resonation and noise can be eliminated completely.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

Figure 1:
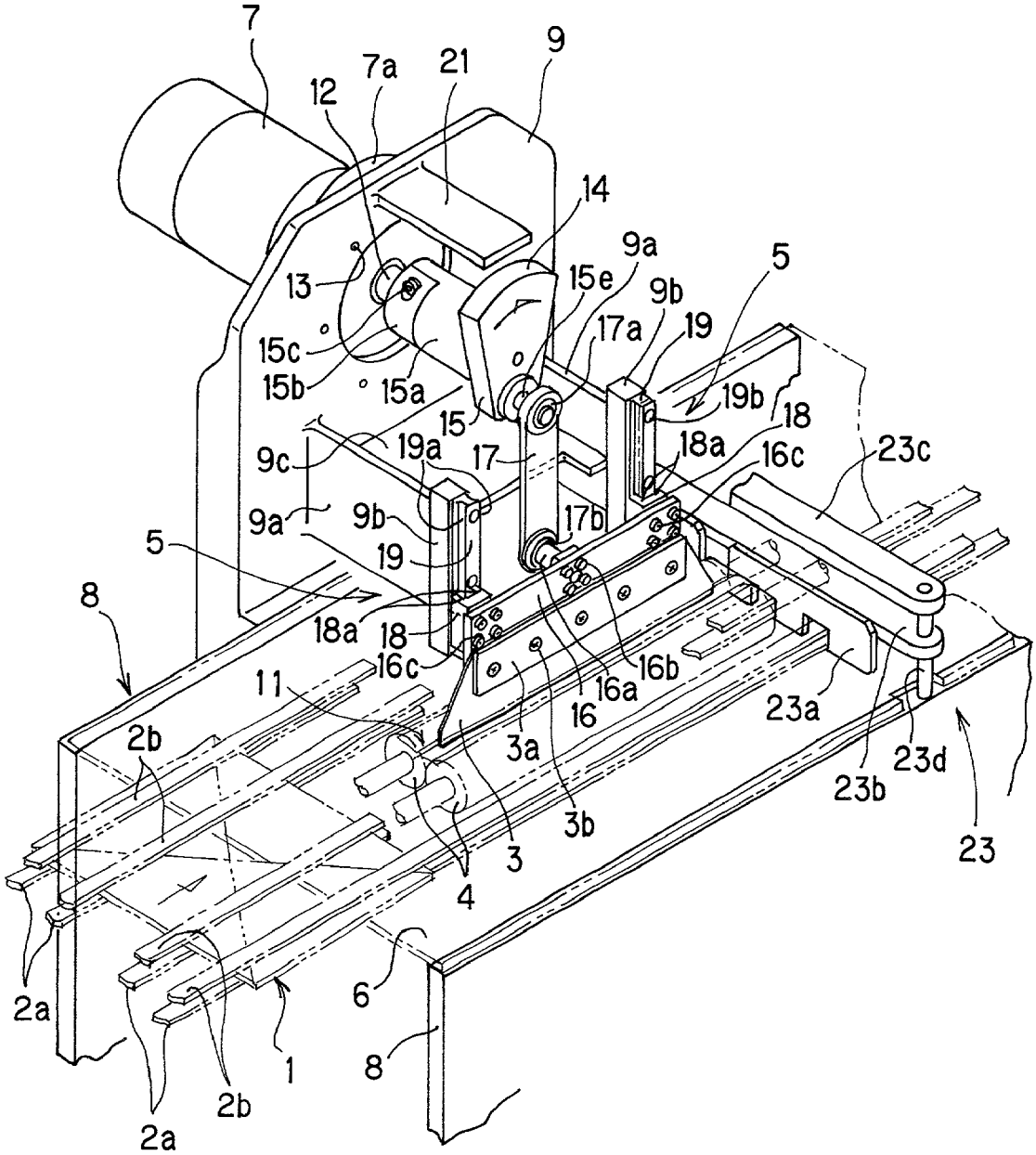
FIG. 1 is a perspective view of a chopper folder according to an embodiment of the present invention.

A chopper folder for a rotary press according to an embodiment of the present invention will be described with reference to the drawings.

In the chopper folder, vertical frames 8 extending in a conveyance direction of a signature 1 are disposed in parallel, with a predetermined clearance being formed therebetween, to thereby define the width of a conveyance plane along which the signature 1 is conveyed. Opposite side edges of a chopper table 6, which defines the conveyance plane, are fixed to the upper ends of the frames 8. A slit-shaped opening 11 is formed in the chopper table 6 at a central region of the chopper table 6 with respect to the conveyance direction of the signature 1. The opening 11 is located substantially at the center of the chopper table 6 with respect to the transverse direction, or the direction perpendicular to the conveyance direction, and has a length greater than the length of the signature 1 in the conveyance direction of the signature 1.

Two folding rollers 4 are disposed immediately under the chopper table 6 in such a manner that the folding rollers 4 extend parallel to the longitudinal direction of the opening 11 and face each other. As will be described later, the folding rollers 4 are rotated in opposite directions by means of an unillustrated drive unit, in order to feed downward the signature 1 while nipping it therebetween, when the signature 1 is pushed into the opening 11 by a chopper blade 3.

The slit-shaped opening 11 is formed in such a manner that longitudinally-extending edge portions are bent downward to follow the outer circumferential surfaces of the folding rollers 4, in order to smoothly guide the signature 1, which is pushed by the chopper blade 3 into the space between the folding rollers 4.

A vertical subframe 9 of appropriate width is fixed to the top portion of one frame 8 at a center position in the conveyance direction of the signature 1, by use of bolts 10.

Two plate-shaped brackets 9*a* extending vertically are attached to the front face of the subframe 9 at an intermediate position in the vertical direction, such that the brackets 9*a* project toward a space above the conveyance plane with a predetermined clearance formed between the brackets 9*a* in the conveyance direction. Vertically extending attachment seats 9*b* are formed at the tip ends of the brackets 9*a;* and guide rails 19 each having a vertically extending guide surface 19*a* are attached to the attachment seats 9*b* by use of bolts 19*b*. The lower ends of the brackets 9*b* and the lower ends of the guide rails 19 are separated from the conveyance plane by a predetermined distance; i.e., are located at positions at which the brackets 9*b* and the guide rails 19 do not hinder conveyance of the signature 1 on the conveyance plane and traveling of conveyor belts 2*b,* which will be described later.

In order to increase the rigidity of the attachment seats 9*b* of the brackets 9*a,* a horizontally extending plate-shaped rib 9*c* is disposed between the brackets 9*a* at an intermediate portion in the vertical direction; and the peripheral edge of the rib 9*c* is connected to the opposed inner surfaces of the brackets 9*a* and the front face of the subframe 9.

Sliders 18 are fitted onto the guide rails 19 such a manner that the sliders 18 can move along the guide surfaces 19*a* in the vertical direction, which is perpendicular to the conveyance plane. The sliders 18 and the guide rails 19 constitute guide units 5.

Figure 2:
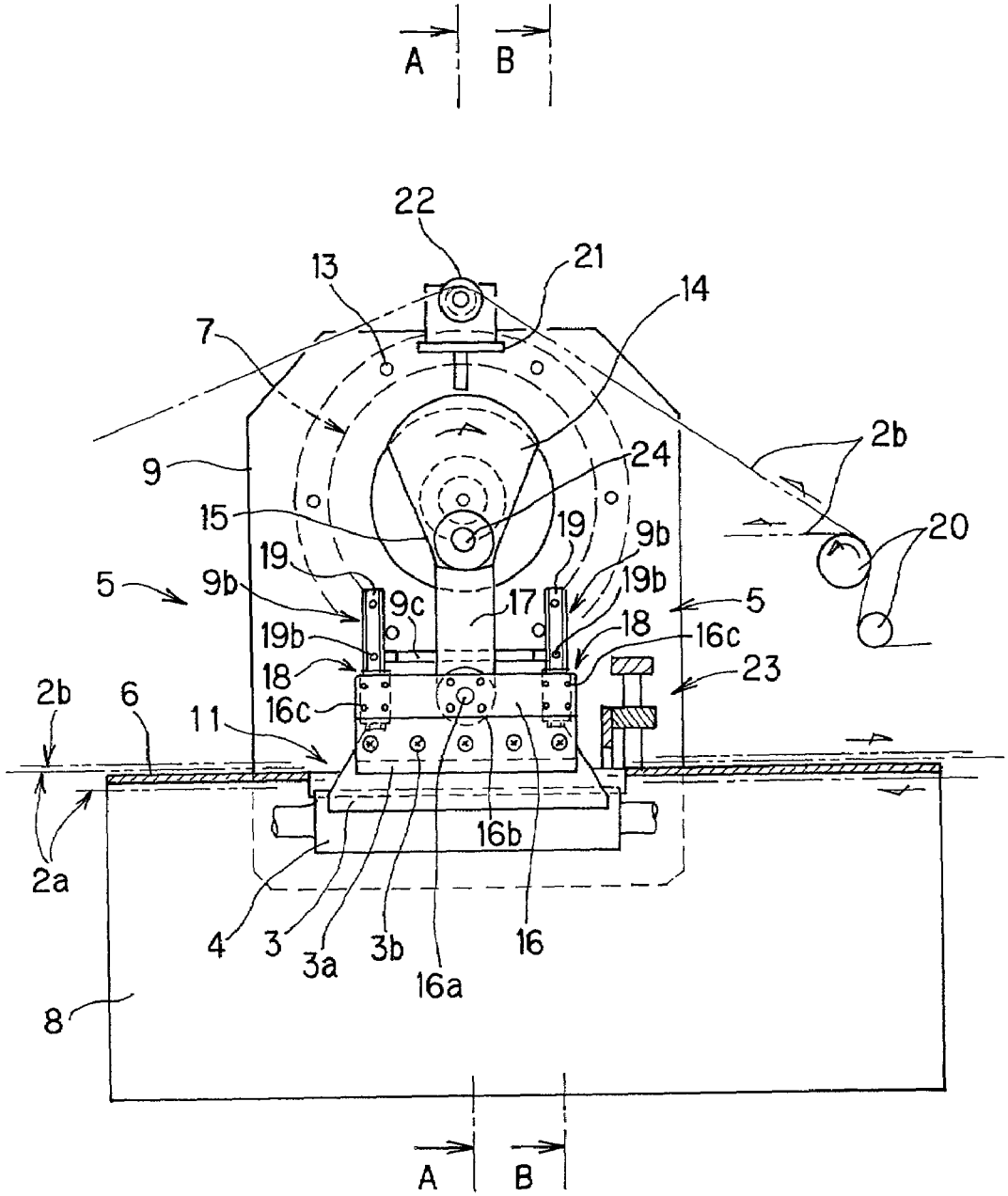
FIG. 2 is a partially sectioned front view of the chopper folder.
Figure 3:
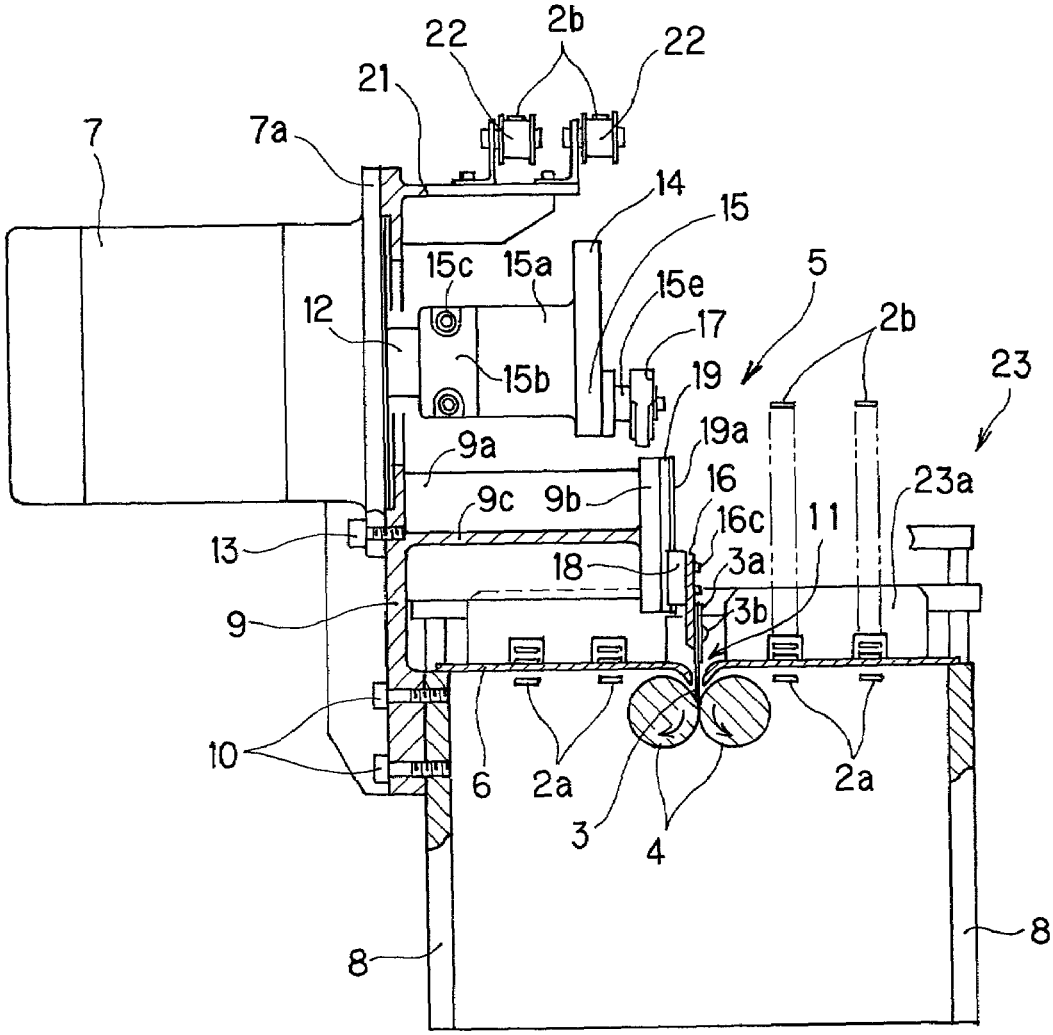
FIG. 3 is a sectional view taken along line A—A in FIG. 2.
Figure 4:
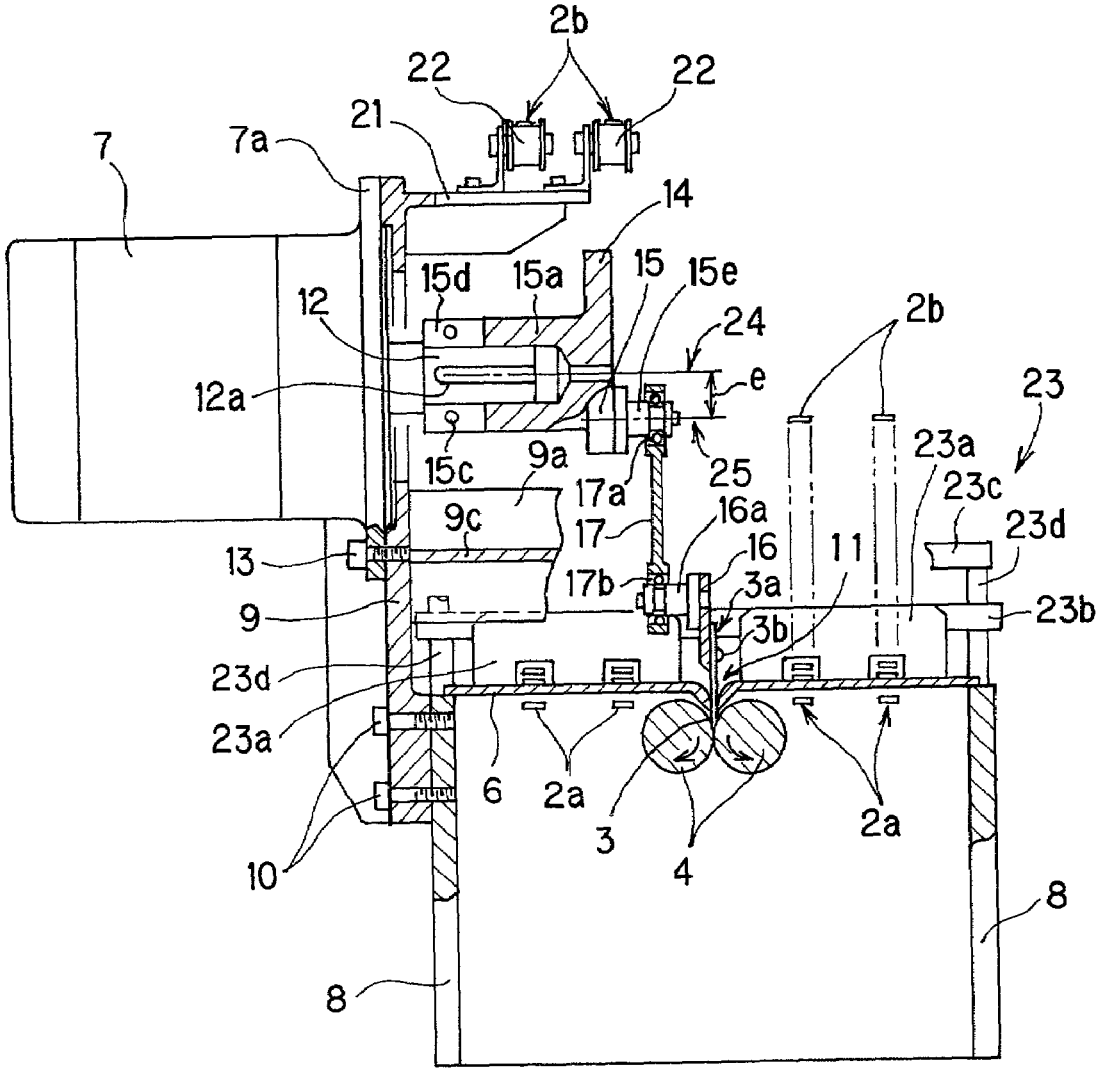
FIG. 4 is a sectional view taken along line B—B in FIG. 2.
Figure 5:
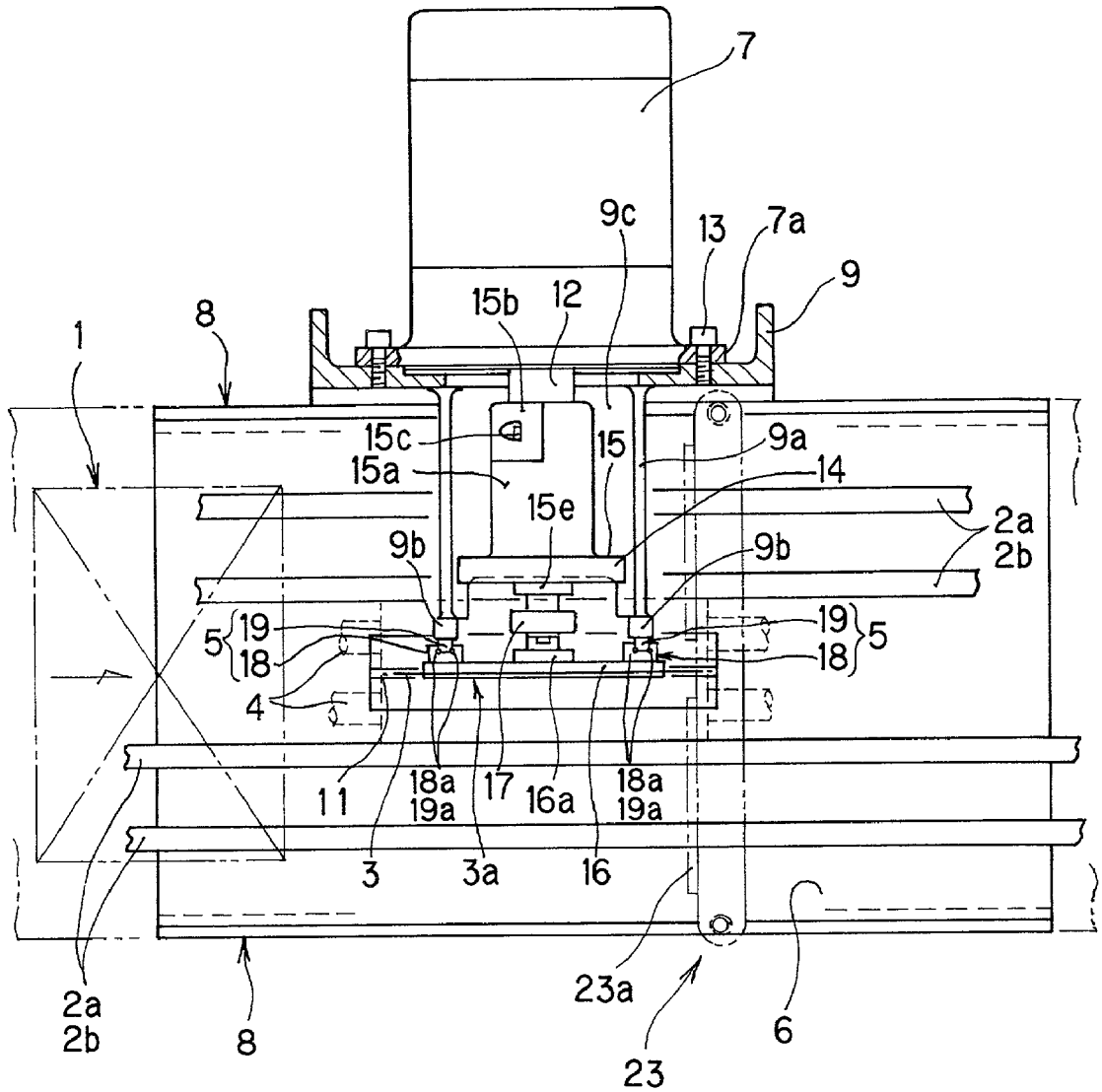
FIG. 5 is a partially sectioned plan view of the chopper folder.

Specifically, as shown in FIGS. 2 and 5, each of the sliders 18 is assembled such that a guided portion 18*a* is guided by the guide surface 19*a* of the guide rail 19, while close contact is maintained therebetween at all times. That is, the guided portion 18*a* of each slider 18 is a rolling guided portion which is constituted by, for example, a plurality of rows of circulating steel balls formed to high accuracy. The rolling guided portion is assembled with a pre-load in order to attain a proper negative radial clearance between the guided portion 18*a* and the guide surface 19*a* of the guide rail 19 serving as a rolling guide surface for the steel balls, so that the slider 18 is smoothly guided by the guide rail 19. For example, a commercially-available linear motion guide (e.g., LM guide, model SSR, product of THK Co., Ltd.), which is inexpensive, provides high performance, and is maintenance free, can be used as the steel-ball circulation guide mechanism.

Longitudinal ends of a blade holder 16 assuming the shape of an elongated plate are fixed to the sliders 18 by use of bolts 16*c*. The chopper blade 3 is fixed to the front face of the blade holder 16 extending in the conveyance direction of the signature 1 via a holding plate 3*a* and by use of bolts 3*b*.

The chopper blade 3 has an appropriate thickness and a length greater than the length of the signature 1 in the conveyance direction of the signature 1 but shorter than the length of the opening 11 of the chopper table 6 in the conveyance direction of the signature 1. The chopper blade 3 pushes the signature 1 through the opening 11 to a folding section defined by opposed peripheral portions of the folding rollers 4, which are provided under the chopper table 6 and are rotated in opposite directions.

The tip end side of the chopper blade 3 facing the folding rollers 4 has such a cross-sectional shape that the thickness decreases gradually toward the above-described folding section at which the folding rollers 4 face each other. This facilitates the operation of pushing the signature 1 into the folding section.

The chopper blade 3 is located at a horizontal position corresponding to that of the slit-shaped opening 11. When the chopper blade 3 is located at a lowered position, which will be described later, the lower edge of the chopper blade 3 enters the opening 11. When the chopper blade 3 is located at an elevated position, the lower edge of the chopper blade 3 is located at a position at which the chopper blade 3 does not hinder passage of the signature 1.

An electric motor 7 serving as a prime mover is fixed to the subframe 9. In order to move the chopper blade 3, the motor 7 is controlled by an unillustrated controller such that the motor 7 rotates in synchronism with operation of an unillustrated folding machine such that the folding operation effected by the chopper folder is synchronized with the period at which signatures are discharged from the folding machine.

Specifically, a flange 7*a* of the motor 7 is fixed to a central portion of the back face of the subframe 9 to be located above the brackets 9*a,* by use of bolts 13. An output shaft 12 of the motor 7 is located at a position corresponding to the longitudinal center of the chopper blade 3 and projects toward the space above the chopper table 6, such that the output shaft 12 extends in a direction parallel to the chopper table 6 and perpendicular to the conveyance direction of the signature 1.

A boss 15*a* of a crank arm 15 is fitted onto the output shaft 12 with a key 12*a* interposed therebetween. The crank arm 15 is fixed to the output shaft 12 by use of a clamping member 15*b* having a shape complementary to the shape of semi-cylindrical cut-away portion 15*d* provide at one end of the boss 15*a* and fitted into the cut-away portion 15*d* while covering the key 12*a;* and bolts 15*c* for fixing the clamping member 15*b* to the boss 15*a*.

The crank arm 15 fixed to the output shaft 12 has a crank pin 15*e* and a counterweight 14 provided on the opposite side of the crank pin 15*e* with respect to a rotary center line 24. The crank pin 15*e* of the crank arm 15 extends in the direction perpendicular to the conveyance direction and is located between the two sliders 18 with respect to the conveyance direction.

The amount of eccentricity e of the crank pin 15*e* with respect to the rotary center line 24 of the motor 7 and the rotary center line 25 of crank arm 15 is half a properly determined stroke within which the chopper blade 3 reciprocates vertically between top dead and bottom dead points.

The amount of eccentricity e can be set freely without any dimensional restriction. That is, the amount of eccentricity e can be set in accordance with the stroke of the chopper blade 3 designated in the specifications of the chopper folder.

In the illustrated example, the crank pin 15*e* is fixedly provided on the crank arm 15. However, in the case in which the stroke of the chopper blade 3 must be changed as needed, the crank pin 15*e* is movably provided on the crank arm 15 such that the amount of eccentricity e can be adjusted through movement of the crank pin 15*e*.

The crank arm 15 is connected to the blade holder 16 via a link 17. Specifically, one end of the link 17 is rotatably attached to the tip end of the crank pin 15*e* via a bearing 17*a*. The other end of the link 17 is rotatably attached via a bearing 17*b* to the tip end of a shaft member 16*a,* which is fixed to the upper end of a longitudinal-center portion of the blade holder 16 via bolts 16*b*.

On the chopper table 6 are provided a plurality of rows (in the illustrated example, four rows) of upper and lower conveyer belts 2*a* and 2*b,* which are superposed on each other in order to convey the signature 1 while holding it from the upper and lower sides. The rows of conveyer belts 2*a* and 2*b* are arranged at positions that do not overlap the opening 11 of the chopper table 6 such that the rows of conveyer belts 2*a* and 2*b* extend parallel in the conveyance direction while being separated from each other by a predetermined distance. The return traveling path of each lower conveyer belt 2*a* is located below the chopper table 6, whereas the return traveling path of each upper conveyer belt 2*b* is located above the chopper table 6. As to two rows of upper conveyer belts 2*b* located between the opening 11 and the subframe 9, a portion of each conveyer belt 2*b* in the return traveling path is caused to travel via tension rollers 20 and a pulley 22 provided on a bracket 21 projecting from the upper portion of the subframe 9.

Further, a stopper unit 23 is provided in order to position the signature 1 conveyed by the conveyer belts 2*a* and 2*b*, to thereby enable the chopper blade 3 to precisely insert the signature 1 into the space between the folding rollers 4.

The stopper unit 23 includes vertical guide bars 23*d* provided on the upper ends of the respective frames 8; and the upper ends of the guide bars 23*d* are connected by a connecting member 23*c* in order to form a gantry shape.

The guide bars 23*d* penetrate holes formed in opposite end portions of a bracket 23*b*. Upper edges of positioning members 23*a* each assuming the shape of a laterally-elongated plate are fixed to the bracket 23*b*. The bracket 23*b* is moved upward and downward by an unillustrated elevation means, while being guided by the guide bars 23*d*.

When the bracket 23*b* is moved to a lowered position, the positioning members 23*a* are moved to a positioning position at which the lower edges of the positioning members 23*a* come into contact with the chopper table 6. When the bracket 23*b* is moved to an elevated position, the positioning members 23*a* are moved to a retreat position at which the lower edges of the positioning members 23*a* do not hinder passage of the signature 1 conveyed by the conveyer belts 2*a* and 2*b*.

Cutaways are formed in lower end portions of the positioning members 23*a* in order to avoid interference between the positioning members 23*a* and the conveyer belts 2*a* and 2*b*, which interference would otherwise occur when the positioning members 23*a* are moved to the positioning position.

Preferably, a mechanism for adjusting the positions of the positioning members 23*a* along the conveyance direction is provided. For example, a mechanism for adjusting the positions of the guide bars 23*d* relative to the frames 8 along the conveyance direction may be interposed between the frames 8 and the guide bars 23*d*. Alternatively, a mechanism for adjusting the positions of the positioning members 23*a* relative to the bracket 23*b* along the conveyance direction may be interposed between the bracket 23*b* and the positioning members 23*a*.

Next, operation of the above-described chopper folder will be described with reference to FIGS. 1 to 5.

When the signature 1 is conveyed by the conveyer belts 2*a* and 2*b* toward downstream side, without undergoing folding operation performed by the chopper folder, the positioning members 23*a* are elevated to the elevated position or retreat position by the unillustrated elevation means. By contrast, when the signature 1 undergoes folding operation, the positioning members 23*a* are lowered to the lowered position or positioning position at which the lower edges of the positioning members 23*a* come into contact with the chopper table 6.

When the motor 7 is operated in synchronism with the period at which the signature 1 is discharged from the folding machine, the crank arm 15 fixed to the output shaft 12 is rotated. As a result, the blade holder 16, which is connected to the crank arm 15 via the link 17, is moved vertically or in the direction perpendicular to the conveyance plane, while being guided by the guide units 5 assembled with a pre-load.

Consequently, the chopper blade 3 fixed to the blade holder 16 is reciprocated vertically in synchronism with the period at which the signature 1 is discharged from the folding machine.

When the leading edge of the signature 1 conveyed by the conveyer belts 2*a* and 2*b* abuts the positioning members 23*a* located at the positioning position and thus the signature 1 is positioned, the chopper blade 3 moves downward from the top dead point to the bottom dead point to thereby push the positioned signature 1 into the space between the folding rollers 4.

The timing at which the chopper blade 3 pushes the positioned signature 1 into the space between the folding rollers 4 is properly determined to be immediately after the timing at which the conveyed signature 1 abuts the positioning members 23*a* of the stopper unit 23, so that the signature 1 is smoothly inserted into the space between the folding rollers 4 by the chopper blade 3, while the leading edge of the signature 1 is guided by the positioning members 23*a*. Subsequently, the chopper blade 3 moves upward form the bottom dead point to the top dead point. The chopper blade 3 repeats the above-described motion in order to insert, into the space between the folding rollers 4, each of signatures periodically conveyed from the folding machine.

One end portion of the link 17 connected to the crank pin 15*e* of the crank arm 15 is swung about the shaft member 16*a* to which the vertically-moving other end of the link 17 is connected, so that the one end, together with the crank pin 15*e*, describes a circle having a radius equal to the amount of eccentricity e. As a result, rotating or reciprocating members, such as the crank arm 15, the crank pin 15*e*, the link 17, the shaft member 16*a*, the blade holder 16, the sliders 18, and the chopper blade 3, serve as imbalance loads acting on the output shaft 12 during rotation thereof, resulting in generation of vibration and noise. In order cope with this problem, a counterweight 14 having a mass equivalent to the imbalance load is provided on the side opposite to the side toward which imbalance force acts, so that a balanced state is established by the counterweight 14.

Moreover, the chopper folder is assembled in such a manner that the clearances of the bearings 17*a* and 17*b* in the radial direction and the clearances of the rolling guide surfaces 19*a* of the guide rails 19 in the radial direction are set to a proper negative value. Therefore, these components always maintain close contact with counterpart components.

Accordingly, even when the rotary press is operated at high speed, the chopper blade 3 guided by the guide units 5 pushes the signature 1 into the space between the folding rollers 4 without vibrating. Thus, the signature 1 having been folded by the folding rollers 4 is free from problems such as the problem of a center line extending in the conveyance direction being curved and the problem of the surface being damaged.

As is apparent from the above description, in the present embodiment of the invention, no gear unit is used, and members, such as gears, which require precise machining and assembly are unnecessary. Thus, a compact, inexpensive drive transmission system which can attain dynamic balance easily and has a very simple configuration can be obtained.

Moreover, the bearings 17*a* and 17*b* of the link 17 have no play in the radial direction, and no play is present between the rolling guided portions 18*a* of the sliders 18 of the guide units 5 and the rolling guide surfaces 19*a* of the guide rails 19. Therefore, neither vibration nor resultant resonation and noise are generated, so that durability is improved.

The chopper blade 3 attached to the blade holder 16 can be reciprocated linearly in the vertical direction without generation of any imbalance force. Therefore, the maximum number of times the chopper blade 3 can push the signature 1 into the space between the folding rollers 4 can be increased considerably as compared with the conventional apparatuses.

Specifically, a test performed by the assignee of the present invention revealed the following. In the case of the mechanisms employed in the conventional apparatuses, the maximum operation speed is as low as 700 operations of folding per minute. By contrast, in the case of the chopper folder according to the present embodiment, the chopper blade 3 can be operated at speed as high as 900 operations of folding per minute, without any deterioration in quality of the signature 1.

As described above, the motor 7 must be operated by the controller such that the motor 7 rotates in synchronism with the period at which the signature 1 is discharged from the folding machine. In addition, the timing at which the chopper blade 3 folds the signature 1 must be changed in accordance with the conveyance velocity, size, mass, and number of folded sheets of the signature 1.

That is, the timing of folding the signature 1 is adjusted by the controller such that the folding is performed at the best timing, to thereby avoid a situation such that the signature 1 is pushed toward the folding rollers 4 in an unstable state in which conveyance of the signature 1 is continued after the signature 1 has abutted the positioning members 23*a* of the stopper unit 23 or the signature 1 has not reached the positioning members 23*a* of the stopper unit 23, which would result in deteriorated folding accuracy of and damage to the signature 1.

Needless to say, in place of manual adjustment performed whenever one of the above-described factors changes, the timing of operating the chopper blade 3 can be adjusted automatically. Specifically, the position and conveyance speed of the signature 1 are detected by use of sensors, and signals output from the sensors are fed to the above-described controller. On the basis of the signals, the controller properly changes the relationship between the position of the signature 1 and the rotation phase of the crank arm 15 rotated by the motor 7, such that the chopper blade 3 is operated at an optimal timing.

Obviously, numerous modifications and variations of the present invention are possible in light of the above teachings. It is therefore to be understood that within the scope of the appended claims, the present invention may be practiced otherwise than as specifically described herein.

What is claimed is:

1. A chopper folder for a rotary press for folding signatures which are periodically conveyed, one signature at a time, from a folding machine, comprising:

a pair of folding rollers for folding a signature parallel to a conveyance direction of said signatures;

a prime mover;

a crank arm fixed to an output shaft of the prime mover to be rotated together with the output shaft;

a blade holder connected to the crank arm via a link;

a chopper blade held in the blade holder and adapted to push the signature from an upper surface thereof in order to insert the signature into a space between the pair of folding rollers; and at least one guide unit with at least a linear guide rail connected to a linear slider wherein the linear slider is connected to the blade holder for restricting motion of the blade holder such that the blade holder reciprocates only in a linear direction perpendicular to a conveyance plane along which the signature is conveyed.

2. A chopper folder for a rotary press for folding signatures which are periodically conveyed, one signature at a time, from a folding machine, comprising:

a pair of folding rollers for folding a signature parallel to a conveyance direction of said signatures;

a prime mover;

a crank arm fixed to an output shaft of the prime mover to be rotated together with the output shaft;

a blade holder connected to the crank arm via a link;

a chopper blade held in the blade holder and adapted to push the signature from an upper surface thereof in order to insert the signature into a space between the pair of folding rollers; and at least one guide unit for restricting motion of the blade holder such that the blade holder reciprocates only in a direction perpendicular to a conveyance plane along which the signature is conveyed, wherein the guide unit comprises sliders provided at opposite ends of the blade holder, and two guide rails arranged along the conveyance direction and adapted to guide the sliders;

the guide rails are supported such that a clearance greater than a thickness of the signature is provided between the guide rails and the conveyance plane, and each of the guide rails has a guide surface perpendicular to the conveyance plane; and the sliders having guided portions that are movable, while maintaining close contact with guide surfaces of the guide rails at all times.

* * * * *